US005331889A

United States Patent [19]

Bartlett et al.

[11] Patent Number: 5,331,889

[45] Date of Patent: Jul. 26, 1994

[54] MANUAL MULTIPLE SIZE CAN CRUSHER

[75] Inventors: Laurence Bartlett, Colchester; John Cowan, Richmond; Harold Coyle, No. Ferrisburg; Robert DeGuise, Milton, all of Vt.

[73] Assignee: Edlund Company, Inc., Burlington, Vt.

[21] Appl. No.: 951,383

[22] Filed: Sep. 25, 1992

[51] Int. Cl.[5] ..... B30B 9/32

[52] U.S. Cl. ..... 100/137; 100/233; 100/283; 100/295; 100/902

[58] Field of Search ..... 100/137, 233, 266, 283, 100/295, 902

[56] References Cited

U.S. PATENT DOCUMENTS

| | | | |
|---|---|---|---|
| 1,376,798 | 5/1921 | Courtney | 100/902 X |
| 2,178,461 | 10/1939 | Apprill | 100/902 X |
| 2,638,957 | 5/1953 | Danielson | 100/902 X |
| 2,773,536 | 12/1956 | Lange | 100/902 X |
| 2,920,554 | 1/1960 | Burke | 100/902 X |
| 2,958,273 | 11/1960 | Morrow | 100/902 X |
| 2,982,200 | 5/1961 | Robertson et al. | 100/902 X |
| 3,036,517 | 5/1962 | Malarsky | 100/902 X |
| 3,062,130 | 11/1962 | Huber et al. | 100/902 X |
| 3,095,806 | 7/1963 | Mirkovich | 100/902 X |
| 3,106,888 | 10/1963 | Chapleau | 100/902 X |
| 3,299,802 | 1/1967 | Black, Jr. | 100/902 X |
| 3,374,730 | 3/1968 | Cain | 100/902 X |
| 3,763,772 | 10/1973 | Baker | 100/902 X |
| 3,832,941 | 9/1974 | Moller | 100/902 X |
| 3,853,054 | 12/1974 | Jacobsen | 100/902 X |
| 4,212,242 | 7/1980 | Willis | 100/902 X |
| 4,292,891 | 10/1981 | Shelley | 100/902 X |
| 4,333,397 | 6/1982 | Modes | 100/902 X |
| 4,403,545 | 9/1983 | Toburen et al. | 100/902 X |
| 4,442,768 | 4/1984 | Bailey | 100/902 X |
| 4,532,861 | 8/1985 | Gisselberg, III | 100/902 X |
| 5,158,013 | 10/1992 | Morris | 100/902 X |

FOREIGN PATENT DOCUMENTS

| | | | |
|---|---|---|---|
| 4039545 | 6/1992 | Fed. Rep. of Germany | 100/902 |
| 58-77796 | 5/1983 | Japan | 100/902 |
| 59-1097 | 1/1984 | Japan | 100/902 |
| 2011302 | 7/1979 | United Kingdom | 100/902 |

*Primary Examiner*—Stephen F. Gerrity
*Attorney, Agent, or Firm*—Collard & Roe

[57] ABSTRACT

A manual can crusher for crushing a can having a housing with a top opening for receiving a can to be crushed, a bottom opening for discharging a crushed can, and an interior crushing wall with a creasing block mounted thereon. A crushing ram is disposed within the housing and is pivotable between an open position where the ram is opposite the crushing wall and a closed position where the ram is adjacent to the crushing wall. A longitudinally extending handle is rotatably mounted on the housing, and linkage couples the handle to the ram. A can to be crushed is placed into the top opening and the handle is rotated to move the ram between the open and closed positions via the linkage. The can is crushed against the interior crushing wall until is is sufficiently crushed to be discharged through the bottom opening.

14 Claims, 5 Drawing Sheets

11
12
19
35
38
39
18
36
37
40
42a
42b
27
25
20

MANUAL MULTIPLE SIZE CAN CRUSHER

BACKGROUND OF THE INVENTION

1. Field of the Invention

The invention relates to a manual multiple size can crusher. More specifically, it relates to a can crusher having a handle which operates a movable ram to crease and crush different sized preopened cans.

2. Prior Art

Various types of can crushers are known from the prior art, including powered can crushers, manual can crushers, can crushers with creasing means, etc. Certain electrically-powered can crushers are shown in U.S. Pat. Nos. 2,920,554; 3,036,517; and 3,763,772. The drawbacks of these powered can crushers is that they are costly to operate due to their power consumption, and they present a danger to individuals operating them, for example, if attempts are made to dislodge a jammed can. Furthermore, these powered can crushers do not disclose creasing means which therefore limits the size of a can which can be crushed by the device.

Manual can crushers are known, for example, from U.S. Pat. Nos. 3,299,802 and 4,532,861 which are less costly and safer to operate than the powered can crushers. However, these devices do not have creasing means. The lack of creasing means and the relatively small size of these devices limit the size cans which can be crushed.

The device to Moller, U.S. Pat. No. 3,832,941, discloses creasing means and crushing means which are each operated by a separate lever. However, Moller states that the apparatus is for flattening thin metal cans. Although creasing means are provided, the size of the apparatus prevents larger cans from being crushed.

SUMMARY OF THE INVENTION

It is therefore an object of the present invention to provide a manual multiple size can crusher which overcomes the drawbacks of the prior art and allows multiple sizes of cans to be crushed.

It is a further object of the present invention to provide a can crusher which is inexpensive to manufacture, reliable in operation and inexpensive to operate.

It is still a further object of the present invention to provide a can crusher with creasing means for creasing large cans to easily allow the cans to be crushed flat.

These and other related objects are achieved according to the invention by a manual can crusher for crushing a can having a housing with a top opening for receiving a can to be crushed, a bottom opening for discharging a crushed can, aired all interior crushing wall with a creasing block mounted thereon. A crushing ram is disclosed within the housing and is pivotable between an open position where the ram is opposite the crushing wall and a closed position where the ram is adjacent to the crushing wall. A longitudinally extending handle is rotatably mounted on the housing and linkage means couple the handles to the ram. A can to be crushed is placed into the top opening and the handle is rotated to move the ram between the open and closed positions via the linkage. The can is crushed against the interior crushing wall until is is sufficiently crushed to be discharged through the bottom opening.

BRIEF DESCRIPTION OF THE DRAWINGS

Other objects and features of the present invention will become apparent from the following detailed description considered in connection with the accompanying drawings which discloses one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
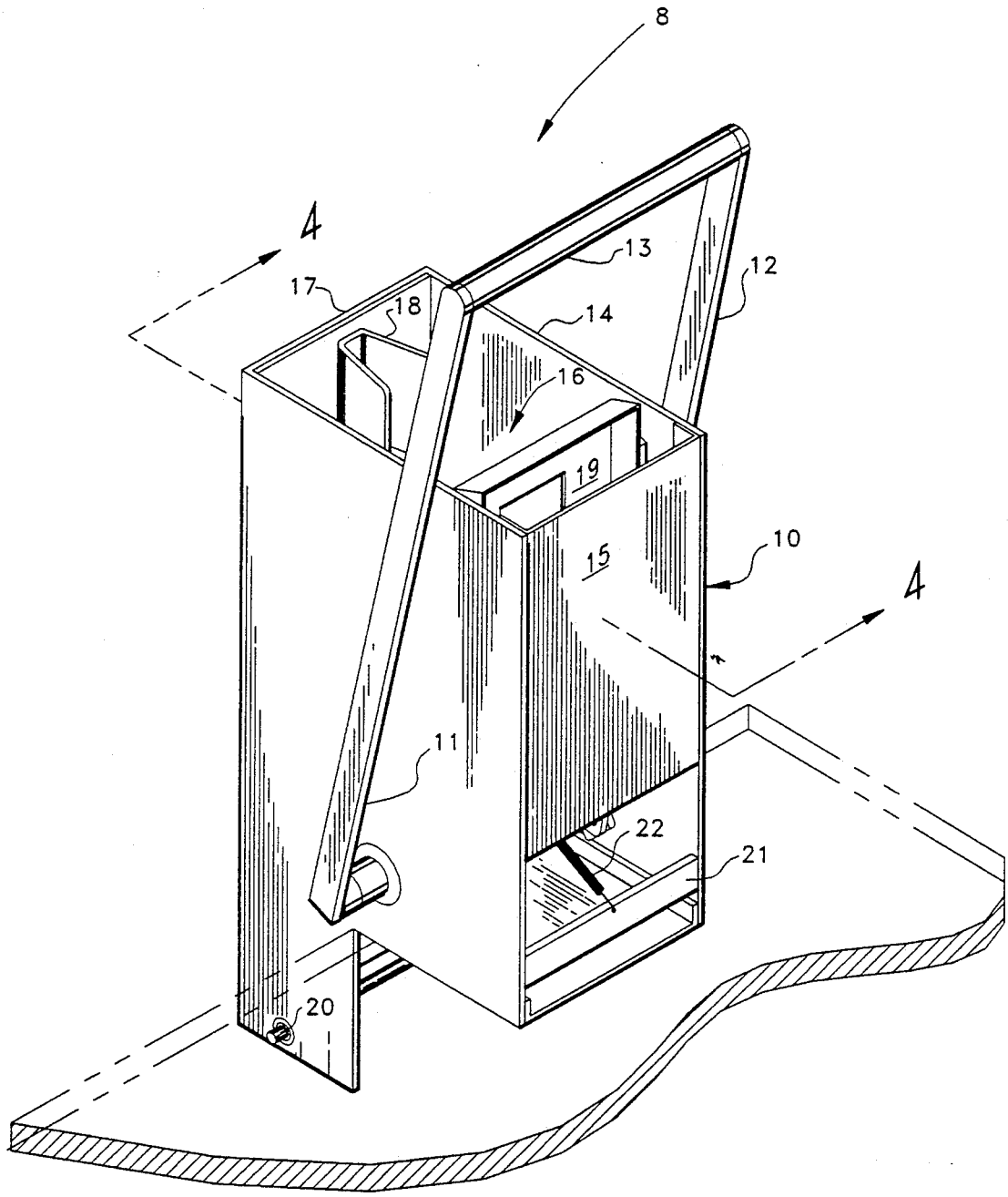
FIG. 1 is a perspective view of a can crusher according to the invention.

Referring now in detail to the drawings and, in particular, FIG. 1, there is shown a manual multiple size can crusher 8 having a housing 10, levers 11 and 12, and a handle 13 attached to the top ends of levers 11 and 12. Levers 11 and 12 are approximately 24 inches long, for example. 10 includes a U-shaped channel 14 and a back panel 15 which together form an elongated rectangular chute 16. U-shaped channel 14 has a front wall 17 where a creasing block 18 is mounted within chute 16. Opposite creasing block 18 is a movable ram 19. Movable ram 19 pivots around pivot axis 20 located at the lower portion of housing 10 and chute 16. Movable ram 19 is pretensioned towards bar 21, located beneath back panel 15, by a spring 22. Housing 10 includes a mounting plate welded into a notch across part of the bottom for mounting the can crusher to a table top.

Creasing block 18 is a V-shaped metal plate mounted on front wall 17 , with the open ends of the V facing ram 19. The open ends of the V have a width, for example, of 2.5 inches. The height of creasing block 18 is 4 inches, and the depth 3 inches. The closed end of the V is slightly square and has a width of about 1 inch. This 1 inch surface provides sufficient area to be welded onto front wall 17. Creasing block 18 is formed from 3/16 inch thick metal which has sufficient strength to precrush large cans without deforming.

Figure 2:
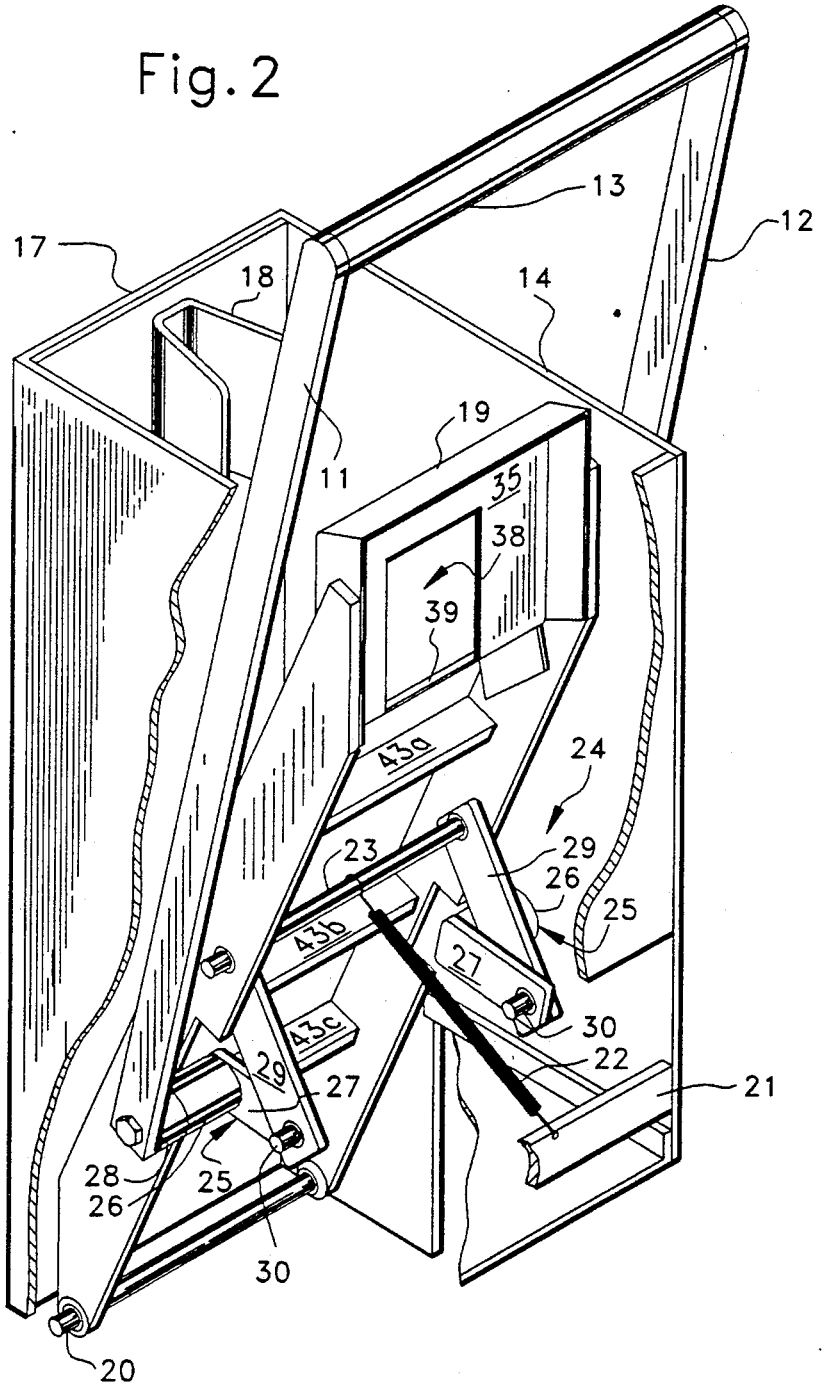
FIG. 2 is a perspective view in part section of the can crusher.

As can be seen in FIG. 2, spring 22 is attached to a link axis 23 which is coupled to the back side of movable ram 19. Link axis 23 is part of a link assembly 24 which couples levers 11 and 12 to movable ram 19. The bottom end of levers 11 and 12 are non-rotatably attached to link drives 25 each of which includes a cylindrical portion 26 and a plate portion 27. Levers 11 and 12 are located outside of U-shaped channel 14 and are connected to link drives 25, which are inside U-shaped channel 14. Levers 11 and 12 drive link drives 25 through a slot machined in an adapter 28 located on the bottom of each lever 11 and 12 and a machined central projection on the end of each link drive 25. Handle 13 and levers 11 and 12 can be removed for storage and shipping.

Figure 4A:
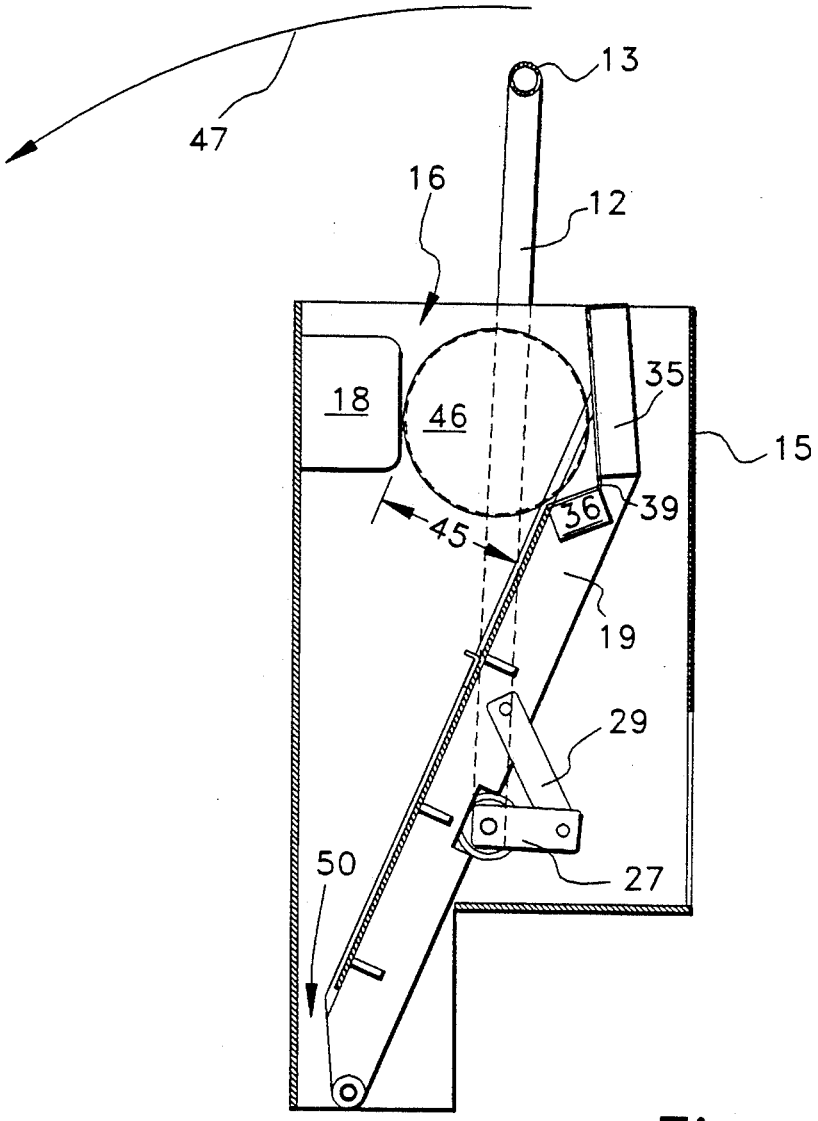
FIGS. 4*a* and 4*b* are two series of side elevational views taken along the line 4—4 from FIG. 1 showing the various stages of creasing and crushing a large can.
Figure 4B:
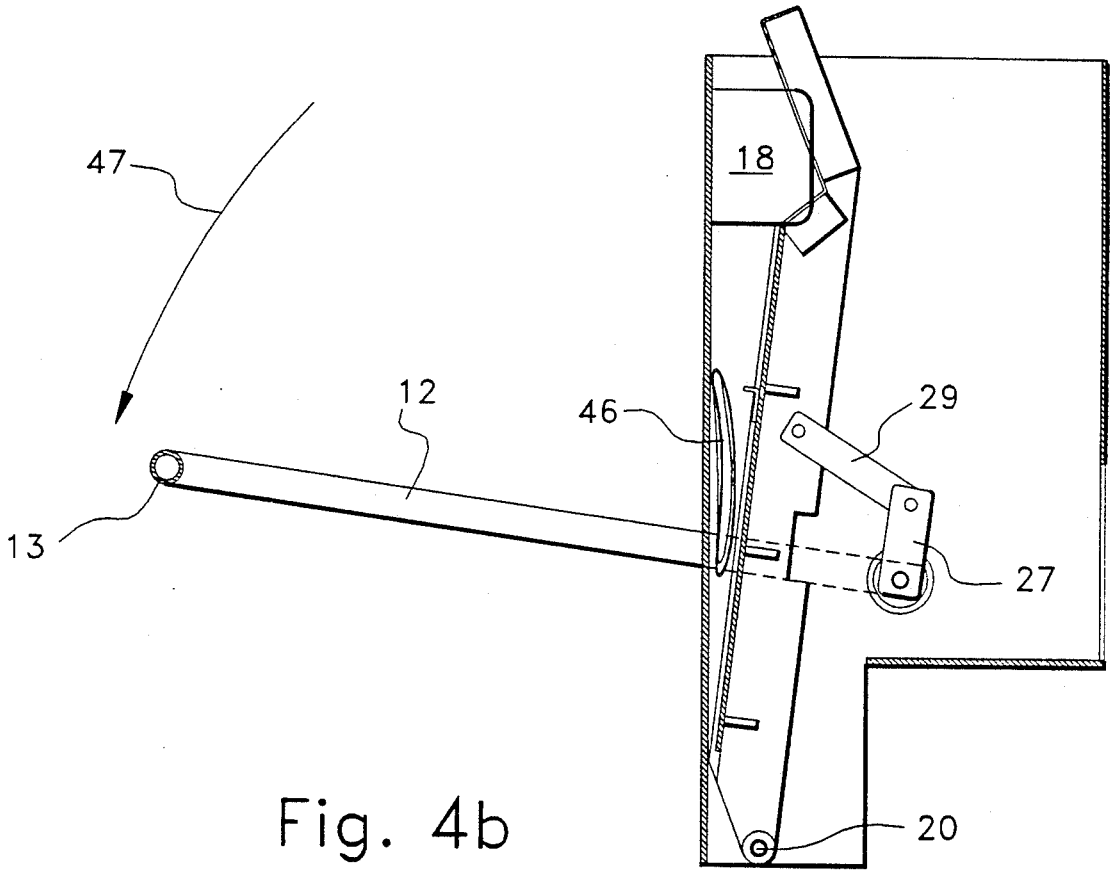

Plate portion 27 of link drives 25 are oriented at approximately 90° with respect to the longitudinal axis of levers 11 and 12. Plate portion 27 of link drive 25 is attached to a link connector 29 by a pin 30. Link connectors 29 are attached to the rear of movable ram 19 by link axis 23. link axis 23 is attached approximately at the middle of ram 19, for example. Link connectors 29 are rotatably mounted at each of their ends so that their orientation with respect to link drives 25 and movable ram 19 changes as handle 13 moves to open and close ram 19. Link connectors 29 are approximately 5 inches long, for example. Plate portion 27 is approximately 3.5 inches long, for example. Link connectors 29 achieve a 90° angle with plate portion 27 (as shown in FIG. 4*b*) when plate portion 27 is approximately 53.7° above a horizontal position.

Figure 3:
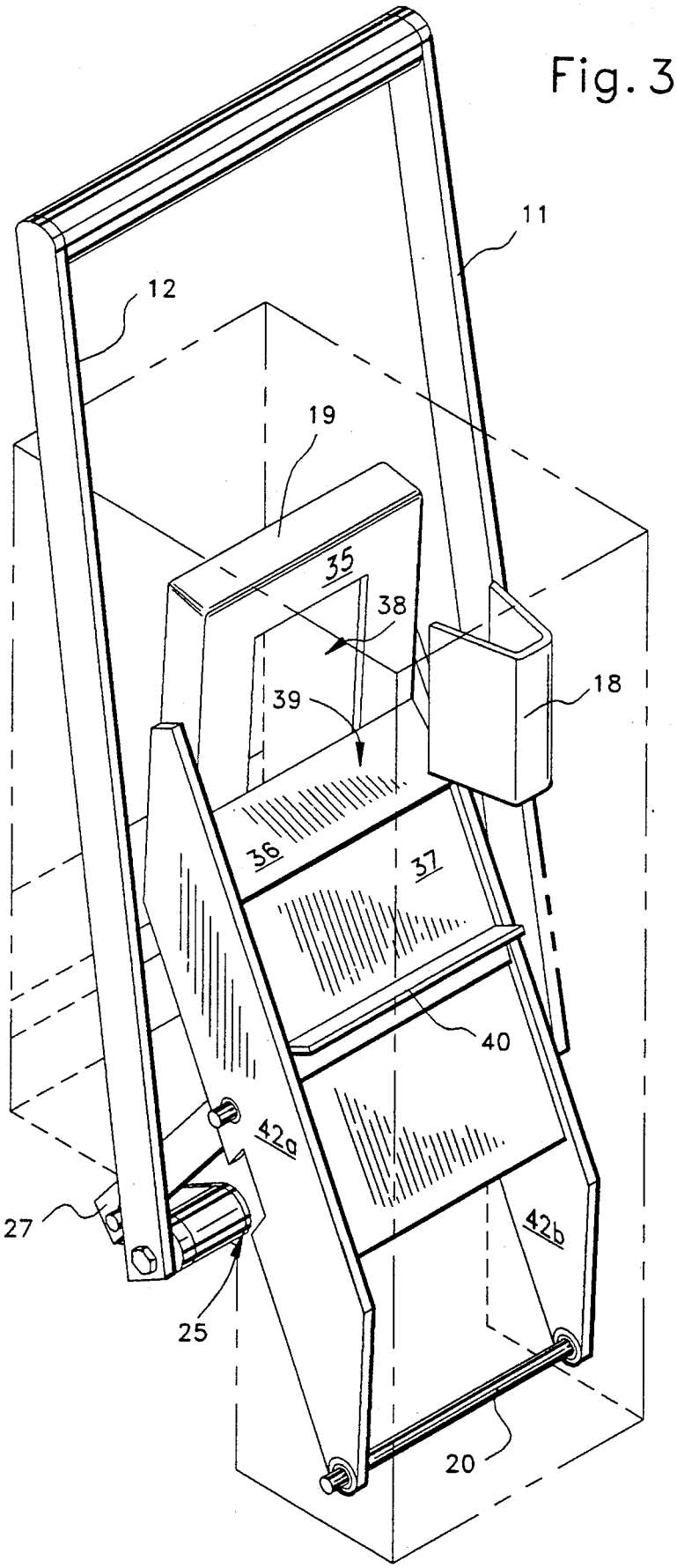
FIG. 3 is a perspective view in part section from the opposite angle of FIGS. 1 and 2.

As can be seen in FIGS. 2 and 3, ram 19 has an upper section 35, a middle section 36 and a lower section 37. Upper section 35 includes an aperture 38 which is slightly larger than creasing block 18. Upper section 35 and middle section 36, together form an L-shaped step 39. The gap between step 39 and creasing block 18 is less than the diameter of a size 603 can which is 6 3/16 of an inch. These large cans would be retained on step 39 for precreasing, while smaller cans would travel further down chute 16 beyond step 39. A stop 40 is mounted on the central portion of lower section 37. Stop 40 is an L-shaped bracket mounted on the face of lower section 37. Side plates 42*a* and 42*b* are mounted perpendicular to the surface of lower section 37. The lower portion of side plates 42*a* and 42*b* are rotatably mounted on pivot axis 20. Approximately half way up side plates 42*a* and 42*b*, link axis 23 is rotatably mounted. Behind lower section 37 are ram stiffeners 43*a*, 43*b*, and 43*c*.

The can crusher operates as follows, reference being made to FIGS. 4*a* and 4*b*. FIG. 4*a* shows the can crusher in its fully opened position with lever 12 pointing generally straight up. The clearance between creasing block 18 and step 39 is shown as distance 45. Can 46 has been placed into chute 16 with the ends of the can facing levers 11 (not shown) and 12. Can 46, for example, is a size 603 can which is 7 inches high and has an outer diameter of 6 3/16 inches. Distance 45 is smaller than the diameter of can 46 to the extent, that can 46 is retained on step 39 with its cylindrical side squarely facing creasing block 18.

Handle 13 is then rotated in the direction of arrow 47 so that creasing block 18 engages and partly crushes the rounded side of can 46. Upper section 35 and middle section 36 of ram 19 hold the opposite side of can 46, so that can 46 does not slip as ram 19 moves toward creasing block 18. As the side of can 46 is precrushed, the circular ends of can 46 will move from a parallel orientation to an angled position in which they point towards creasing block 18. Handle 13 is now moved back up to the vertical position in the direction opposite arrow 47. Precrushed can 46 now has a diameter which is less than distance 45. Can 46 then falls off of step 39 and moves down chute 16 for further crushing. The precrushing decreases the amount of force required to crush the larger diameter cans to a manageable level.

FIG. 4*b* shows can 46 which is below stop 40 and is held within chute 16 by stop 40. Handle 13 is again moved in the direction of arrow 47 to its terminal position which is approximately horizontal. In the event that the force required to crush can 46 exceeds the force which can be exerted by the operator, handle 13 is alternately rotated up and down, further crushing can 46 with each downward stroke. As can 46 moves closer to pivot point 20, the mechanical advantage increases until the operator can move handle 13 into the horizontal position, closing ram 19 and flattening can 46. Handle 13 is then rotated back up to the vertical position and can 46 passes through exit 50 (see FIG. 4*a*) out of chute 16.

Can crusher 8 is designed to crush all sizes of preopened empty cans from size 202 (2.125 inches outer diameter) to size 603 (6.1875 inches outer diameter, seven inches high) cans. To crush a medium or small size can, the can is placed into chute 16 in any orientation. Since only the larger cans will be retained on step 39, a medium or small size can will pass down chute 16 until it is cooperatively retained by front wall 17 and movable ram 19. Handle 13 is rotated in the direction of arrow 47, moving ram 19 towards front wall 17 to crush the can. If the force required to pull handle 13 down becomes too high, handle 13 is rotated in a direction opposite arrow 47 to move ram 19 away from front wall 17. The partially crushed can will then fall further down chute 16, where it can be crushed flat.

While only a single embodiment of the present invention has been shown and described, it is to be understood that many changes and modifications may be made thereunto without departing from the spirit and scope of the invention as defined in the appended claims.

What is claimed is:

1. A manual can crusher for crushing variously sized cans, comprising:

a housing having a top opening for receiving a can to be crushed, a bottom opening for discharging a crushed can, and an interior crushing wall with a creasing block mounted thereon;

a crushing ram including a step disposed within said housing, said crushing ram and said step being pivotable between an open position where said ram is opposite said crushing wall, with said step and said creasing block defining a predetermined clearance therebetween, and a closed position where said ram and said step are adjacent said crushing wall;

wherein said step and said creasing block cooperatively support a can to be creased by said creasing block; and a longitudinally extending handle rotatably mounted on said housing, and linkage means for coupling said handle to said ram, whereas a can to be crushed is placed into the top opening and selectively retained adjacent said creasing block by said step based on the size of the can with respect to said clearance, said handle is rotated to move said ram between the open and closed positions via said linkage means, to (i) selectively precrush the can against said creasing block, and (ii) crush the can against said interior crushing wall, until it is sufficiently crushed to be discharged through the bottom opening.

2. A manual can crusher according to claim 1, wherein said housing has a rectangular cross section and includes a front wall, a back wall and two sides walls, said interior crushing wall being located on one side of said front wall.

3. A manual can crusher according to claim 2, wherein said crushing ram is pivotable between an open position, where said ram is adjacent said back wall, and a closed position where said ram is adjacent said front wall.

4. A manual can crusher according to claim 3, wherein said crushing ram is pivotable about a pivot axis, which is rotatably supported by said two side walls.

5. A manual can crusher according to claim 4, wherein said linkage means comprises:

a cylindrical coupling attached to said handle and passing through one of said two side walls;

a plate having a first end attached to said cylindrical coupling and a second end; and a link connector having a first end rotatably coupled to said ram and a second end rotatably coupled to said second end of said plate.

6. A manual can crusher according to claim 5, wherein said ram includes a crushing surface which is generally parallel to said front and back walls of said housing when said ram is in the closed position.

7. A manual can crusher according to claim 6, wherein said ram additionally includes side plates mounted perpendicular to said crushing surface and generally parallel to said side walls.

8. A manual can crusher according to claim 7, additionally including a link axis which is rotatably mounted onto said side plates, said first end of said link connector being rotatably mounted on said link axis.

9. A manual can crusher for crushing a can, comprising:

a housing having a top opening for receiving a can to be crushed, a bottom opening for discharging a crushed can, and an interior crushing wall with a creasing block mounted thereon, said housing having a rectangular cross section and including a front wall, a back wall and two side walls, said interior crushing wall being located on one side of said front wall;

a crushing ram disposed within said housing and pivotable between an open position where said ram is adjacent said back wall and opposite said crushing wall, and a closed position where said ram is adjacent said crushing wall of said front wall, said crushing ram being pivotable about a pivot axis, which is rotatably supported by said two side walls, said ram including a crushing surface which is generally parallel to said front and back walls of said housing when said ram is in the closed position, said ram additionally including side plate mounted perpendicular to said crushing surface and generally parallel to said side walls; and a longitudinally extending handle rotatably mounted on said housing, and linkage means for coupling said handle to said ram, said linkage means comprising:

(a) a cylindrical coupling attached to said handle and passing through one of said two side walls;

(b) a plate having a first end attached to said cylindrical coupling and a second end; and (c) a link connector having a first end rotatably coupled to said ram and a second end rotatably coupled to said second end of said plate;

a link axis rotatably mounted onto said side plates, said first end of said link connector being rotatably mounted on said link axis;

a spring attached to said link axis and said back wall of said housing for biasing said ram in the open position, wherein said link axis is generally located in the middle of said ram; and whereas a can to be crushed is placed into the top opening and said handle is rotated to move said ram between the open and closed positions via said linkage means to crush the can against said interior crushing wall until it is sufficiently crushed, to be discharged through the bottom opening.

10. A manual can crusher according to claim 9, wherein said pivot axis is mounted adjacent to the bottom opening of said housing and said side plates of said ram are pivotally mounted on said pivot axis.

11. A manual can crusher according to claim 10, wherein said ram includes an aperture adjacent a top end of said ram, for receiving said creasing block when said ram is in the closed position.

12. A manual can crusher according to claim 11, wherein said plate of said linkage means is securely mounted to said cylindrical coupling and said longitudinally extending handle, said plate extending generally perpendicular to the longitudinal axis of said handle.

13. A manual can crusher according to claim 12, wherein said link connector is generally perpendicular to said plate, when said ram is in the closed position.

14. A manual can crusher according to claim 13, wherein said ram includes a step adjacent to the aperture, said step and said creasing block cooperatively supporting a can when said ram is in the open position, so that said creasing block creases the can when said handle is rotated to move said ram from the open to the closed position.

* * * * *